United States Patent [19]

Yasui

[11] Patent Number: 4,522,427

[45] Date of Patent: Jun. 11, 1985

[54] SLIPS

[76] Inventor: Taro Yasui, 2597-3, Tanigawa Tanagawa, Misaki-cho, Sennan-gun, Osaka, Japan

[21] Appl. No.: 465,338

[22] Filed: Feb. 9, 1983

[30] Foreign Application Priority Data

Dec. 14, 1982 [JP] Japan ..... 57-189650[U]

[51] Int. Cl.[3] ..... B42D 15/00; B42D 15/04

[52] U.S. Cl. ..... 281/5; 283/62

[58] Field of Search ..... 281/2, 5; 283/61, 62, 283/81; 229/69

[56] References Cited

U.S. PATENT DOCUMENTS

| | | | |
|---|---|---|---|
| 1,028,684 | 6/1912 | Daly | 283/62 |
| 1,187,682 | 6/1916 | Trueman | 283/62 |
| 1,363,081 | 12/1920 | Brown | 283/62 |
| 2,377,968 | 6/1945 | Richman | 283/62 |
| 2,637,571 | 5/1953 | Tilly | 283/62 |
| 2,706,865 | 4/1955 | Miller | 283/81 |
| 4,055,294 | 10/1977 | Traise | 229/69 |

FOREIGN PATENT DOCUMENTS

| | | | |
|---|---|---|---|
| 2835217 | 2/1980 | Fed. Rep. of Germany | 281/5 |
| 1558515 | 1/1980 | United Kingdom | 229/69 |

*Primary Examiner*—Paul A. Bell
*Assistant Examiner*—Paul M. Heyrana
*Attorney, Agent, or Firm*—Wenderoth, Lind & Ponack

[57] ABSTRACT

A series of four slips is used for the payment of a tax, etc. Intermediate slips are equal in width to each other. Another pair of side slips provided opposite to each other with the intermediate slips interposed therebetween are likewise equal in width to each other, but the width of these two side slips is larger than that of the intermediate slips. A slip disposed at an end of the series is provided with a transparent panel through which the name and address of a taxpayer, etc. typed on the adjacent slip are visible when the series is folded. The series of the four slips serves also as an envelope.

5 Claims, 7 Drawing Figures

SLIPS

BACKGROUND OF THE INVENTION

The present invention relates to an improvement in a vertical or lateral series of four slips.

In order that the payment of a tax or payment for an article bought on time may be made at the window of a post office or a bank, it is a common practice that a person to whom money is to be paid sends a lateral series of four slips to a person by whom the payment should be made. In the case of payment for an article bought on time, the lateral series of four slips consists of a notification for payment, a payment slip, a credit slip, and a receipt. In the case of payment of a tax, it consists of a receipt, a statement of payment, a notice of the tax paid, and a reminder.

In order to mail such a lateral series of four slips, it has been a common practice to fold it in four and put it in an envelope. This is an uneconomical operation.

SUMMARY OF THE INVENTION

It is an object of the present invention to eliminate the above-described disadvantage by providing a series of four slips which serves also as an envelope by itself when folded.

With this object in view, the invention will become apparent from the following detailed description, which will be more clearly understood in connection with the accompanying drawings.

DETAILED DESCRIPTION OF THE INVENTION

Figure 1:
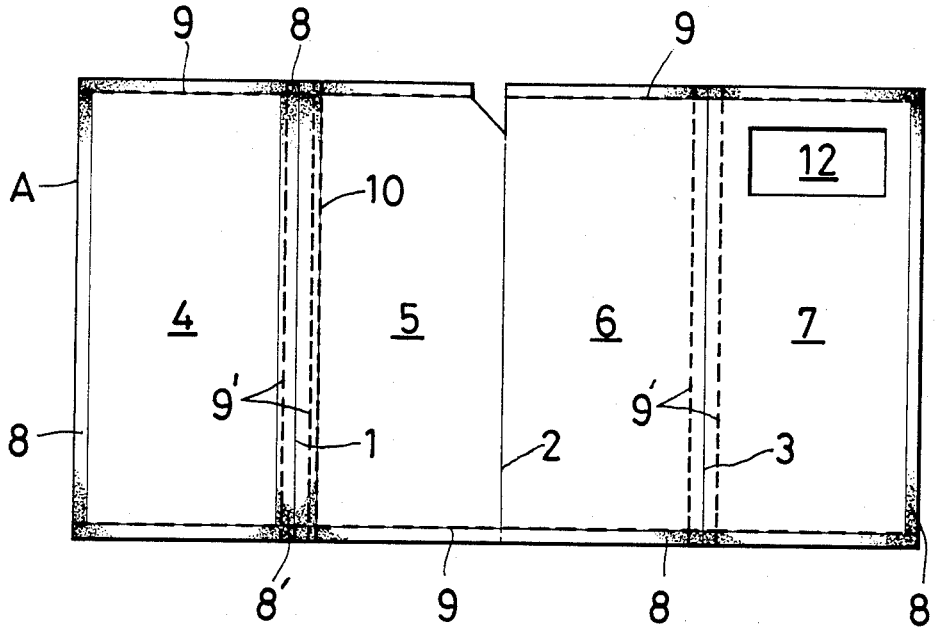
FIG. 1 is a front view of an embodiment of the present invention.
Figure 2:
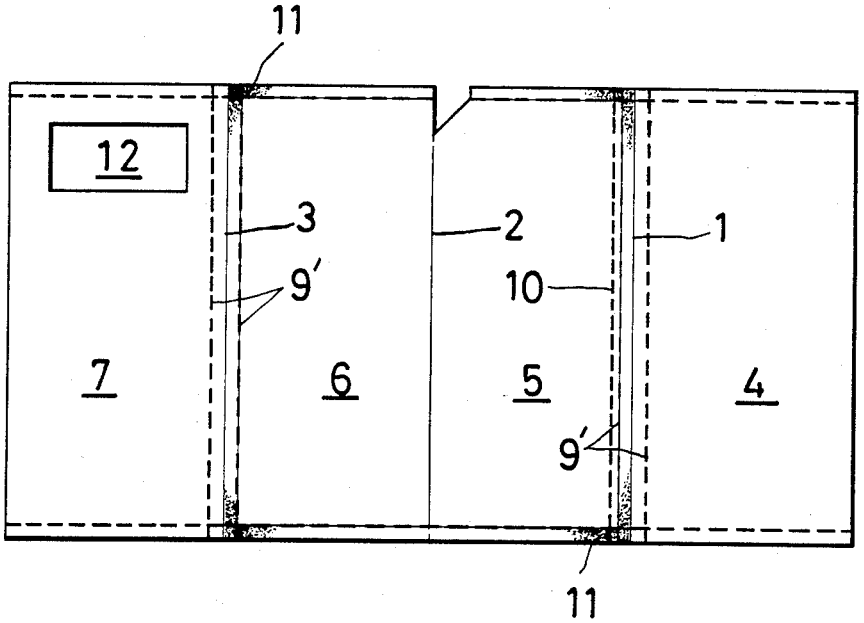
FIG. 2 is a back view thereof.

Referring now to FIGS. 1 and 2, a lateral series of slips in accordance with the present invention is made of a rectangular paper sheet A which is divided into four slips 4, 5, 6 and 7 and adapted to be folded in four along lines 1, 2 and 3 in such a manner that the front sides of the slips 4 and 5, the reverse sides of the slips 5 and 6, and the front sides of the slips 6 and 7 come into contact with each other. The lines 1, 2 and 3 run parallel with the transverse edges of the rectangular paper sheet A. The line 2 divides the rectangular paper sheet A into two equal parts. The slip 4 is equal in width to the slip 7, and the slip 5 is equal in width to the slip 6. The width of the slips 4 and 7 is larger than that of the slips 5 and 6.

A margin 8, having applied thereto an adhesive, is provided along the four edges of the rectangular paper sheet A on the front side thereof. Another margin 8′, having applied thereto an adhesive, is provided on both sides of the line 1 on the front side of the paper sheet A. A line of transverse perforations 9 for tearing therealong is provided along each of the upper and lower longitudinal edges of the rectangular paper sheet A.

Two lines of longitudinal perforations 9′ are provided on both sides of each of the lines 1 and 3 in such a manner that the spacing between each pair of the two lines of perforations 9′ is narrower than the margin 8′.

A solvent-sensitive, pressure-sensitive or heat-sensitive adhesive may be used as the adhesive for the margins 8 and 8′. If a pressure-sensitive adhesive is used, strips of paper to which a surface lubricant is applied are placed on the margins 8 and 8′.

A line of perforations 10 is provided in the slip 5 on one edge of the margin 8′. As shown in FIG. 2, margins 11, having applied thereto an adhesive, are provided on the reverse side of the slips 5 and 6 along the lines 1 and 3 and along the upper and lower edges of the slips 5 and 6. The width of the margins 11 provided along the lines 1 and 3 is defined by these lines and the lines 9′, while the margins 11 provided along the upper and lower edges of the slips 5 and 6 are equal in width to the margins 8.

The slip 7 is provided with a window 12 to which a transparent film such as cellophane may be affixed. In the alternative, a chemical adapted to form a transparent film when cured may be applied to the window 12.

In use, the rectangular paper sheet A is folded in four along the lines 1, 2 and 3 in such a manner that the front sides of the slips 4 and 5, the reverse sides of the slips 5 and 6, and the front sides of the slips 6 and 7 come into contact with each other. Then the margins 8 provided on the side edges of the slips 4 and 7 project sideways from the fold made along the line 2 and face each other. The margins 8 provided along the upper and lower edges of the slips 4 and 5 also face each other, and so do those provided along the upper and lower edges of the slips 6 and 7, respectively. The margins 11 provided along the edges of the slips 5 and 6 on the reverse side thereof also face each other.

Figure 3:
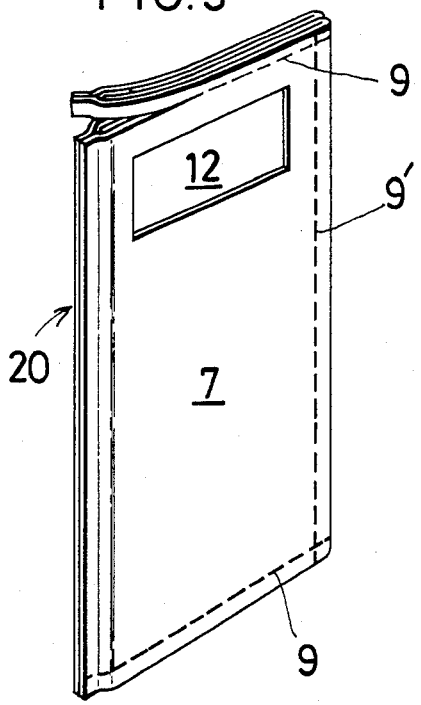
FIG. 3 is a perspective view thereof, showing the series of slips folded in four so as to allow a portion thereof to be formed into an envelope.
Figure 4:
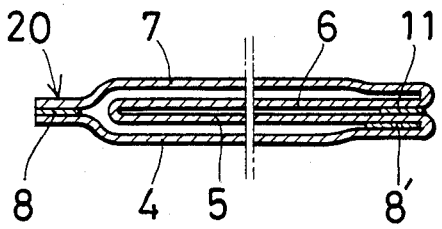
FIG. 4 is a transverse sectional view thereof.
Figure 5:
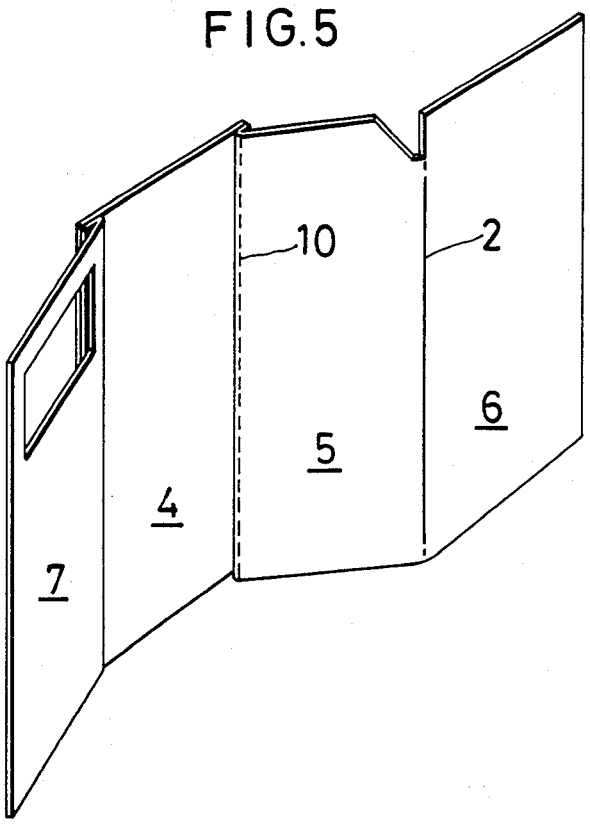
FIG. 5 is a perspective view thereof, showing the envelope opened.

When the above-mentioned margins facing each other have been adhered due to the adhesive, an envelope 20 as shown in FIGS. 3 and 4 is formed, which is provided with lines of perforations 9 and 9′ along its three edges. When the margin of the envelope 20 has been torn away along the lines of perforations 9 and 9′, a lateral series of slips including the slips 7, 4, 5 and 6 is obtained, with the front sides of these slips facing to the same direction as shown in FIG. 5.

The lateral series of slips in accordance with the present invention can be used for a taxpayer to pay his tax at the window of a post office or a bank. In this case, the lateral series of four slips comprises a receipt 4, a statement of payment 5, a notice of the tax paid 6, and a reminder 7. The slips 4 and 7 (receipt and reminder) can be separated from the slips 5 and 6 along the line of perforations 10 so that the clerk at the window of a post office or a bank can deliver the slips 4 and 7 to the taxpayer after receipt of payment. Since the slip 7 has a transparent panel in the form of the window 12, the name and address of a taxpayer typed on the slip 6 are visible to the clerks of post offices when the slips are formed into a sealed envelope and mailed.

Figure 6:
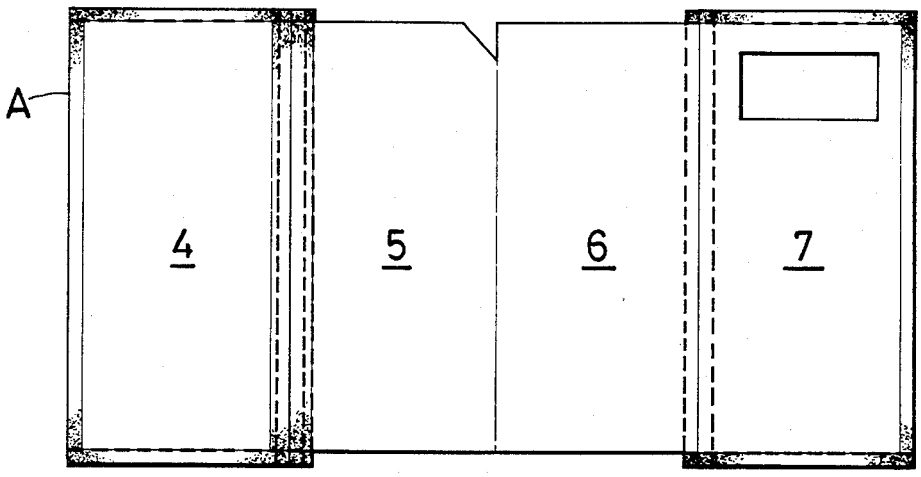
FIGS. 6 and 7 are front views of other embodiments of the present invention.

Although the four slips in accordance with the first embodiment of the present invention are equal in length measured along the lines 1, 2 and 3, the slips 5 and 6 may be smaller in length than the slips 4 and 7, provided that the slips 4 and 7 are of the same shape and size and the slips 5 and 6 are also of the same shape and size. This is what characterizes the second and third embodiments of the present invention shown in FIGS. 6 and 7, in which the margins 11 are omitted from the upper and lower edges of the slips 5 and 6.

Figure 7:
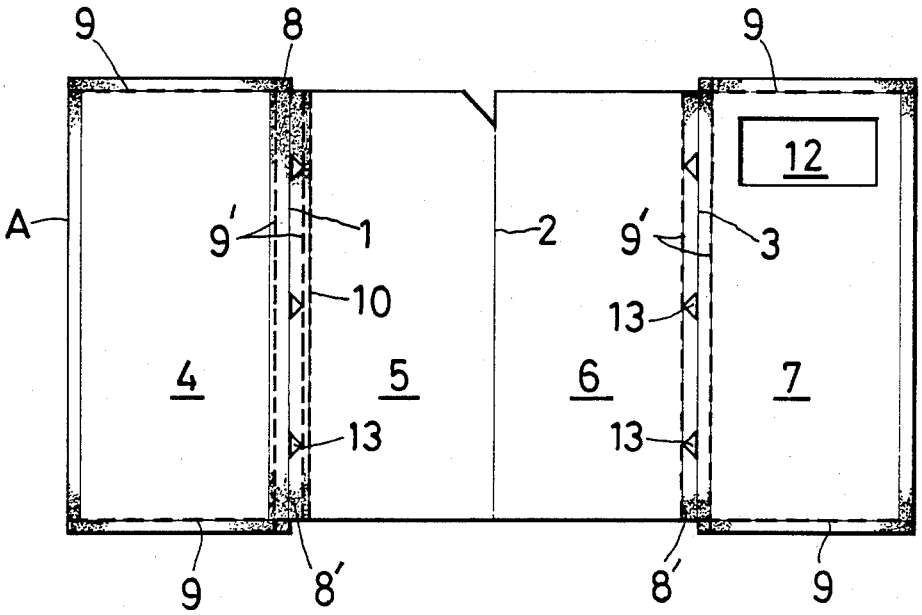

The third embodiment of the present invention shown in FIG. 7 is further characterized in that an adhesive need not be applied to the margins 11 provided along the side edges of the slips 5 and 6 on the reverse side thereof, because these margins are provided with holes 13 through which an adhesive applied to the margin 8' of the slip 4 acts, when the rectangular paper sheet A is folded in four, on the margin provided between the line 3 and the line of perforations 9' on the front side of the slip 7.

While certain embodiments of the present invention have been disclosed, it is to be understood that they are described by way of example only and not in a limiting sense and that the scope of the present invention is determined by the following claims.

What I claim is:

1. A combined arrangement of a series of slips and an envelope, said arrangement comprising:

a single sheet having a front side and a rear side;

said sheet being folded alternately along a center fold line and two lateral fold lines on opposite sides of and parallel to said center fold line to define two intermediate slips joined along said center fold line and two side slips joined to respective said intermediate slips along respective said lateral fold lines, such that front sides of said side slips contact front sides of respective said intermediate slips and rear sides of said intermediate slips are in contact, and such that said intermediate slips are substantially equal in width, said side slips are substantially equal in width, and said side slips are greater in width than said intermediate slips;

each said side slip and the respective said intermediate slip having formed therein, on opposite sides of the respective said lateral fold line, a pair of longitudinal lines of perforations;

each said side slip having formed therein, adjacent opposite longitudinal edges thereof, transverse lines of perforations;

each said side slip having applied to said front side thereof, along margin areas outwardly of said transverse lines of performations and along a margin area adjacent the respective lateral edge of said sheet, a layer of adhesive;

one said side slip and the respective said intermediate slip having applied to said front sides thereof, along a margin area on opposite sides of the respective said lateral fold line, a layer of adhesive having a width greater than the spacing between the respective said pair of longitudinal lines of perforations; and each said intermediate slip having applied to said rear side thereof, along a margin area outwardly of the respective said longitudinal line of perforations, a layer of adhesive.

2. An arrangement as claimed in claim 1, wherein said intermediate slips and said side slips are of equal length, said intermediate slips have formed therein, adjacent opposite longitudinal edges thereof, transverse lines of perforations colinear with said transverse lines of perforations in opposite longitudinal edges of said side slips, and each said intermediate slip having applied to said rear side thereof, along margin areas outwardly of said transverse lines of perforations, layers of adhesive.

3. An arrangement as claimed in claim 1, wherein the length of said side slips is greater than the length of said intermediate slips.

4. An arrangement as claimed in claim 1, wherein at least one of said intermediate slips has formed therein, at an area between the respective said lateral fold line and the respective said longitudinal line of perforations, at least one hole.

5. An arrangement as claimed in claim 1, wherein one of said side slips includes a transparent panel.

* * * * *